US008356890B2

(12) United States Patent
Maruyama

(10) Patent No.: US 8,356,890 B2
(45) Date of Patent: Jan. 22, 2013

(54) PRESSURE REGULATING VALVE FOR INKJET PRINTER

(75) Inventor: Kouji Maruyama, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 71 days.

(21) Appl. No.: 13/069,412

(22) Filed: Mar. 23, 2011

(65) Prior Publication Data

US 2011/0221835 A1 Sep. 15, 2011

Related U.S. Application Data

(63) Continuation of application No. PCT/JP2009/050334, filed on Jan. 14, 2009.

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS

| | | | | |
|---|---|---|---|---|
| 5,668,583 | A * | 9/1997 | Thiel et al. | 347/71 |
| 5,736,992 | A * | 4/1998 | Pawlowski, Jr. | 347/7 |
| 7,188,936 | B2 * | 3/2007 | Usui et al. | 347/85 |
| 2007/0222834 | A1 * | 9/2007 | Seshimo et al. | 347/85 |
| 2008/0297568 | A1 * | 12/2008 | Seshimo | 347/85 |

FOREIGN PATENT DOCUMENTS

| | | |
|---|---|---|
| JP | 09-193414 | 7/1997 |
| JP | 2007-076373 | 3/2007 |

OTHER PUBLICATIONS

International Search Report for corresponding International Application No. PCT/JP2009/050334, Apr. 28, 2009.

* cited by examiner

*Primary Examiner* — Matthew Luu
*Assistant Examiner* — Alexander D Shenderov
(74) *Attorney, Agent, or Firm* — Ditthavong Mori & Steiner, P.C.

(57) ABSTRACT

A pressure regulating valve for an inkjet printer includes a negative pressure generator including a negative pressure chamber, a pressure receiving member, and a pressure device. A sealing valve includes a pressure chamber, a valve element, and a valve element pressing device. A linkage mechanism includes a communication flow chamber and an operating lever swingably provided in the communication flow chamber and including an arm section, a first engagement section, and a second engagement section. A first length of the arm section is greater than a second length of the arm section. The first engagement section is pressed against the pressure receiving member to swing the operating lever and the second engagement section moves the valve element to open the sealing valve when the pressure receiving member is moved inwardly with respect to the negative pressure chamber against a force applied by the pressure device.

3 Claims, 9 Drawing Sheets

PRESSURE REGULATING VALVE FOR INKJET PRINTER

CROSS-REFERENCE TO RELATED APPLICATIONS

The present application is a continuation application of International Application No. PCT/JP2009/050334, filed Jan. 14, 2009. The contents of this application are incorporated herein by reference in their entirety.

BACKGROUND OF THE INVENTION

1. Field of the Invention

The present invention relates to a pressure regulating valve for an inkjet printer.

2. Discussion of the Background

Inkjet printers that are used commercially for making large posters, banners, etc., consume an enormous amount of ink per unit time. Consequently, a large ink reservoir (ink tank, etc.) is provided on a device main body side, and a resin tube, etc., is used to connect the ink reservoir and a print head arranged in a carriage for supplying the ink. To prevent leakage of the ink without inhibiting a discharge action of the ink by the print head, a supply pressure of the ink to the print head is required to be set to a marginally negative pressure of a predetermined value by which a meniscus is formed on an ink fluid surface in a nozzle. Well known systems such as a hydraulic head system and a pressure regulating valve system are available for achieving it. In the hydraulic head system, a structure is used in which a fluid level of the ink in the ink reservoir is somewhat lower than a height of the nozzle. In the pressure regulating valve system, a pressure regulating valve is arranged in an ink supply channel, connecting the ink reservoir and the print head, and a pressure on a print head side is set to a marginally negative value than that of the pressure regulating valve.

The pressure regulating valve used in the pressure regulating valve system includes, as key components, a negative pressure generating unit mounted on one side face of a casing that serves as a base and connected to the print head, and a sealing valve mounted on other side face of the casing across a partition wall and connected to the ink reservoir. The negative pressure generating unit is connected to the print head and includes a negative pressure chamber formed by a first depressed portion on one side face of the casing and a flexible member that covers the first depressed portion, a pressure receiving member that is bonded to the flexible member, and a pressure receiving and biasing unit that biases the pressure receiving member outwardly from the negative pressure chamber. The sealing valve includes a pressure chamber formed by a second depressed portion provided coaxially with the first depressed portion on the other side face of the casing and a shielding member that covers the second depressed portion and that connects with the ink reservoir, a valve element that is arranged in the pressure chamber and that engages with and disengages from the pressure receiving member via an opening that communicates with the negative pressure chamber, and opens and closes the opening, and a valve element biasing unit that biases the valve element in a valve closing direction (for example, refer to Japanese Patent Application Laid-open No. 2007-76373).

In the pressure regulating valve having such a structure, the pressure receiving member, biased by the pressure receiving and biasing unit, causes the flexible member to stretch outwardly, thus expanding a volume of the negative pressure chamber. Due to this, the ink in the negative pressure chamber is siphoned from the print head that is connected to the negative pressure chamber, producing a marginally negative pressure. When the ink is discharged from the print head, the ink in the negative pressure chamber is consumed, and the negative pressure increases, due to a pressure difference with the atmospheric pressure, the flexible member buckles inward into the negative pressure chamber, and is opposed by an urging force. Due to this, the pressure receiving member is caused to move, and push against the valve element, causing the sealing valve to close. Due to this, the ink in the pressure chamber is supplied to the negative pressure chamber through the opening, and due to these actions, an amount of ink that corresponds to an amount of ink consumed is supplied to the negative pressure chamber, and in addition, an exit pressure of the pressure regulating valve, that is, a pressure in the ink supply channel on the print head side is maintained at a marginally negative pressure of a predetermined value.

In such a pressure regulating valve for an inkjet printer, to realize a function of preventing leakage of the ink from the nozzle without inhibiting the discharge action of the ink by the print head, a pressure of the ink that is delivered from the ink reservoir to the print head should be adjusted to a predetermined negative pressure (hereinafter, "head supply pressure") of a narrow range of negative pressure of −0.5 kilopascal (kPa) to −4 kPa. The main factors that regulate a relationship between the head supply pressure and an ink supply are a pressure receiving surface area of the flexible member that is subjected to the pressure difference with the atmospheric pressure, the urging force of the pressure receiving and biasing unit, a pressure receiving surface area of the valve element that is subjected to a fluid pressure of the ink stored in the ink reservoir, and the urging force of the valve element biasing unit.

The urging forces of the pressure receiving and biasing unit and the valve element biasing unit, which are typically springs, vary according to individual differences of the biasing units and the way they are assembled. It is extremely difficult to stably construct (manufacture) a biasing unit with a reduced urging force. In such a case, when the head supply pressure drops below the range (for example, to −5 kPa), the meniscus in the nozzle is lost and ink discharge stops. Furthermore, a minute amount of air in the ink is formed into bubbles in the negative pressure chamber, and the head supply pressure varies, leading to unstable ink discharge. As a measure to prevent such a problem, if tolerance levels (margins) are increased for the variations in the urging forces produced by the pressure receiving and biasing unit and the valve element biasing unit or for the variations in the fluid pressure of the ink stored in the ink reservoir, a surface area of the flexible member must be increased, resulting in a loss of compactness of the pressure regulating valve.

SUMMARY OF THE INVENTION

According to one aspect of the present invention, a pressure regulating valve for an inkjet printer includes a negative pressure generator, a sealing valve, and a linkage mechanism. The negative pressure generator includes a negative pressure chamber, a pressure receiving member, and a pressure device. The negative pressure chamber includes a first depressed portion and a flexible member. The first depressed portion is formed by a first surrounding wall in a casing that is to be a base. The flexible member covers the first depressed portion to connect the first depressed portion to a print head of the inkjet printer. The print head is connected to an ink reservoir through an ink supply channel. The pressure regulating valve is provided in the ink supply channel to regulate a pressure of an ink to be supplied to the print head. The pressure receiving member is connected to the flexible member. The pressure device presses the pressure receiving member outwardly with respect to the negative pressure chamber. The sealing valve includes a pressure chamber, a valve element, and a valve element pressing device. The pressure chamber includes a second depressed portion and a first shielding member. The second depressed portion is formed by a second surrounding wall in the casing. The first shielding member covers the second depressed portion to connect the second depressed portion to the ink reservoir. The valve element opens and closes a second opening provided in the pressure chamber. The valve element pressing device presses the valve element in a valve closing direction. The linkage mechanism includes a communication flow chamber and an operating lever. The communication flow chamber includes a concave groove and a second shielding member. The concave groove is formed by a third surrounding wall in the casing. The second shielding member covers the concave groove. The communication flow chamber connects a first opening and the second opening. The first opening communicates with the negative pressure chamber. The second opening communicates with the pressure chamber. The operating lever is swingably provided in the communication flow chamber. The operating lever includes an arm section, a first engagement section, a second engagement section, and a swinging fulcrum. The arm section extends in a longitudinal direction of the operating lever and has a first end portion and a second end portion opposite to the first end portion in the longitudinal direction. The first engagement section is provided at the first end portion to engage with and disengage from the pressure receiving member. The second engagement section is provided at the second end portion to engage with and disengages from the valve element. The swinging fulcrum is provided between the first engagement section and the second engagement section in the longitudinal direction. A first length of the arm section between the swinging fulcrum and the first engagement section is greater than a second length of the arm section between the swinging fulcrum and the second engagement section in the longitudinal direction. The first engagement section is pressed against the pressure receiving member to swing the operating lever and the second engagement section moves the valve element in a valve opening direction to open the sealing valve when the pressure receiving member is moved inwardly with respect to the negative pressure chamber against a force applied by the pressure device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 2:
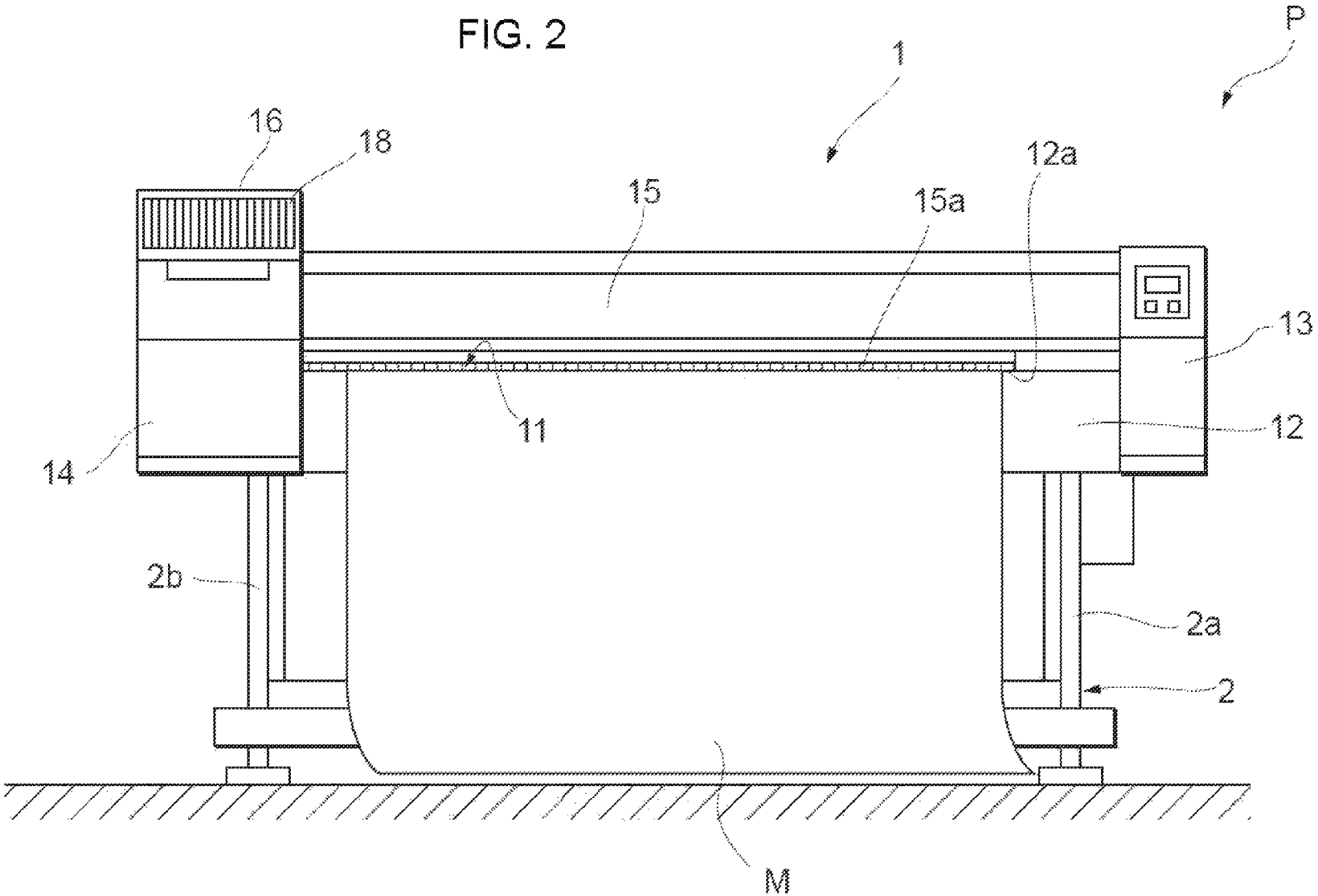
FIG. 2 is a front elevation view of an inkjet printer presented as an example of the application of the embodiment of the present invention.

The embodiments of the present invention are explained below with reference to the accompanying drawings, wherein like reference numerals designate corresponding or identical elements throughout the various drawings. As an example of an inkjet printer adapted for a pressure regulating valve according to the embodiment of the present invention, an inkjet printer (hereinafter, "printer device") P is shown in FIG. 2 having a configuration such that, out of two orthogonal axes of a printing surface, a printing medium moves along one axis while a print head moves along the other axis. The printer device is explained with reference to FIG. 2. In the following explanation, up, down, left, and right directions are defined based on the layout of FIG. 2, and a front surface of the sheet represents the front and a back of the sheet represents the rear.

The printer device P has a rectangular shape overall, and includes a body 1 that performs a drawing function and supporting legs 2 that support the body 1 and that consist of left and right legs 2*a* and 2*b*. The body 1 consists of a lower body section 12, a right body section 13 that lies to the right of the lower body section 12, a left body section 14 that lies to the left of the lower body section 12, an upper body section 15 that lies above and separated from the lower body section 12, and extends across connecting the left body section 14 and the right body section 13, and a medium inserting section 11 that is in the form of a transversely long opening for inserting a printing medium M anteroposteriorly and that is surrounded by the body sections 12 to 15.

A platen 12*a* extends across horizontally on an upper surface of the lower body section 12 beneath the medium inserting section. A medium feed roller (not shown) having a cylindrical shape with its upper peripheral surface exposed to the platen 12*a* is provided. The printing medium M that is loaded on the platen 12*a* is transported in an anteroposterior direction by rotating the medium feed roller while the printing medium M is pressed down by a pinch roller 15*a* that lies on a lower surface side of the upper body section 15.

Though details of parts inside the upper body section 15 are not shown in the drawing, a guide rail is provided above the medium inserting section 11 and that extends horizontally. A carriage is provided that is movable horizontally via a sliding block that fits into the guide rail. The carriage includes a print head that is arranged facing the platen 12*a* and that has a plurality of rows of nozzles as well as a carriage moving mechanism for moving the carriage in the upper body section 15, the left body section, and the right body section, and the print head is moved back and forth horizontally over the printing medium M supported by the platen 12*a*.

Figure 3:
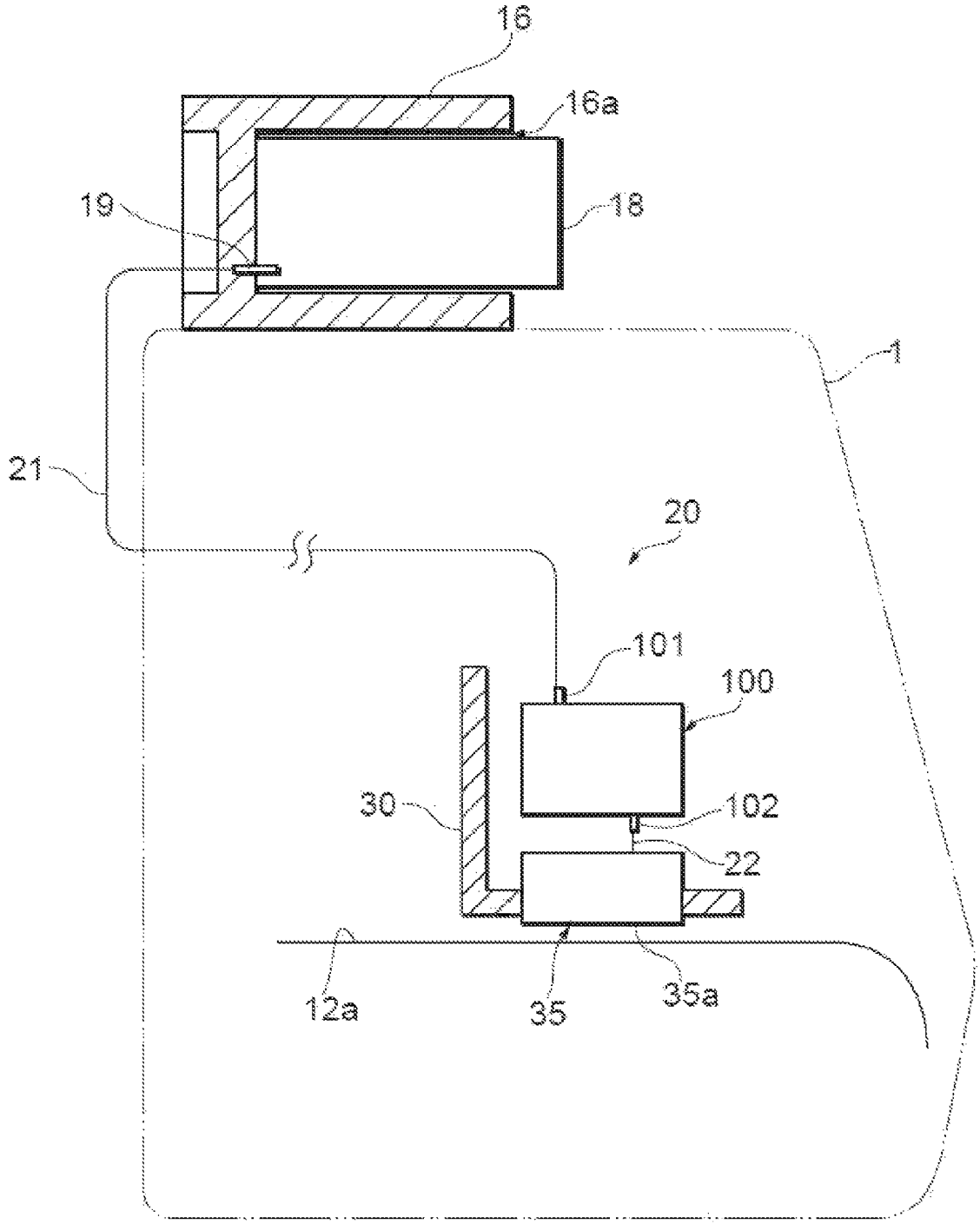
FIG. 3 is a schematic diagram of an ink supply channel.

An operating switch type or a display device type is provided on a front surface of the right body section 13. A maintenance station for performing suction operation during ink changing, for cleaning of the print head, etc., is provided in the lower body section 12 adjacent to the right body section. A box-shaped cartridge mounting unit 16 with a plurality of receptive slots is provided above the left body section 14. A cartridge type ink tank 18 that serves as an ink reservoir can be fitted into and removed from each of the receptive slots of the cartridge mounting unit 16 from the front. As shown in a schematic diagram of an ink supply channel in FIG. 3, a connecting unit 19 that is attachable to and detachable from an ink supply slot on the ink tank 18 side is provided in an interior section of a receptive slot 16*a*. When the ink tank 18 is fitted into the receptive slot 16*a*, the connecting unit 19 is connected to the ink tank 18, and an ink stored inside the tank is received into the printer device. An ink tube 21 made of a flexible resin is connected to the connecting unit 19. The ink tube 21 extends inside the left body section 14 and the upper body section 15, and is connected to a print head 35 provided in a carriage 30, thus forming an ink supply channel 20.

In the printer device P, the cartridge mounting unit 16 is provided above the left body section 14, and a fluid level of the ink stored in the ink tank 18 is higher than a nozzle surface 35*a* of the print head 35 provided in the carriage 30. In other words, a pressure equivalent to a difference in height (hydraulic head) with the fluid level of the ink tank 18 acts at a downstream end of the ink tube 21. The same is applicable in a printer in which even if the ink tank 18 is fitted at a lower level than the print head 35, and pressure is to be applied to the ink tank to pressure feed the ink.

In the printer device P, to make the supply pressure of the ink to the print head 35 marginally negative, a pressure regulating valve (also known as pressure damper) 100 for regulating the ink pressure is provided in the ink supply channel 20 that connects the ink tank 18 and the print head 35. In the present embodiment, the pressure regulating valve 100 is provided in the carriage 30. The ink tank 18 is connected to an input port 101 of the pressure regulating valve 100 via the ink tube 21, and the print head 35 is connected to an output port 102 of the pressure regulating valve 100 via a head supply line 22.

Figure 1:
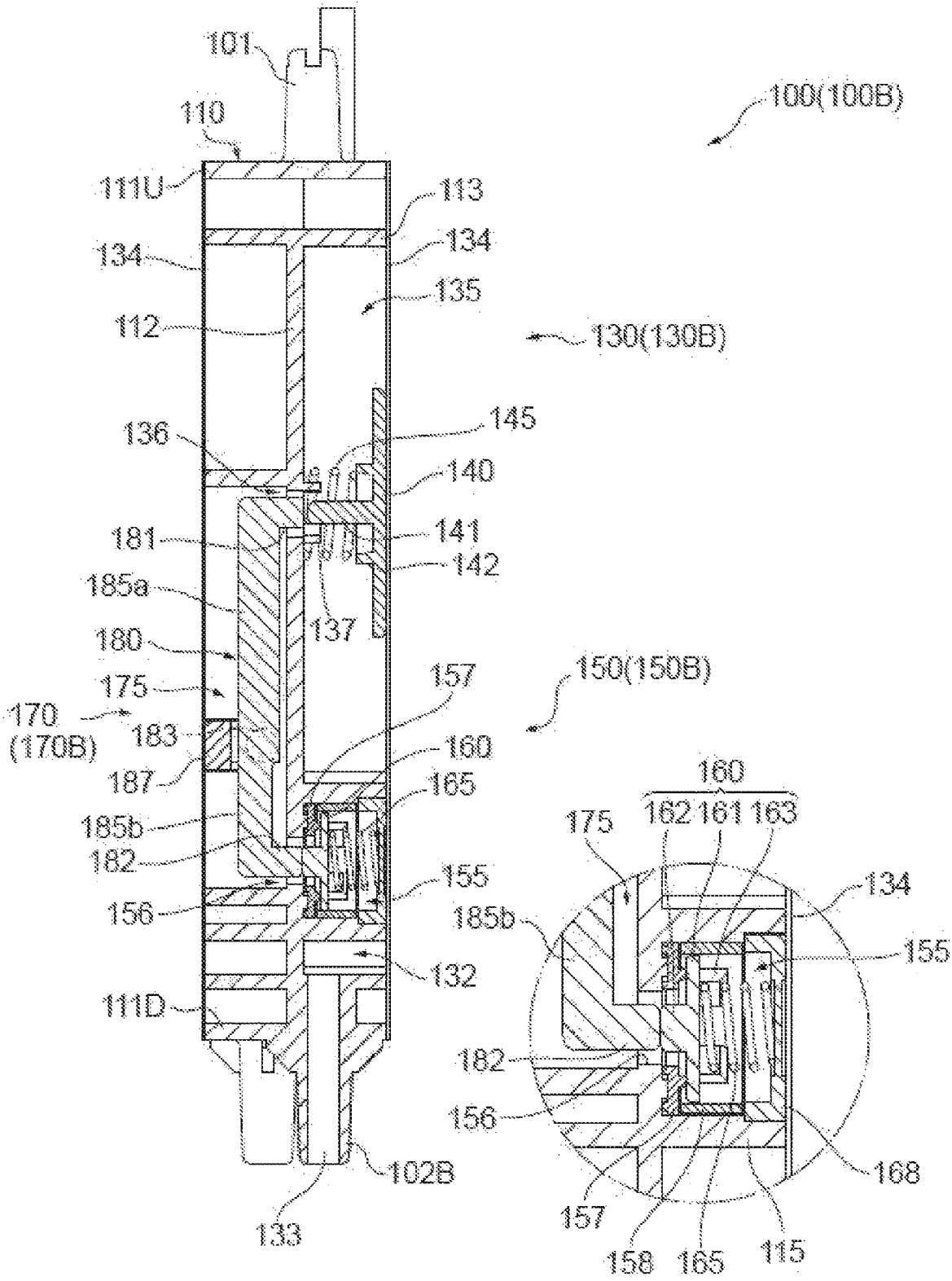
FIG. 1 is a typical cross-sectional view (along arrows I-I of FIG. 5) showing a principal structure of a pressure regulating valve according to an embodiment of the present invention.
Figure 4:
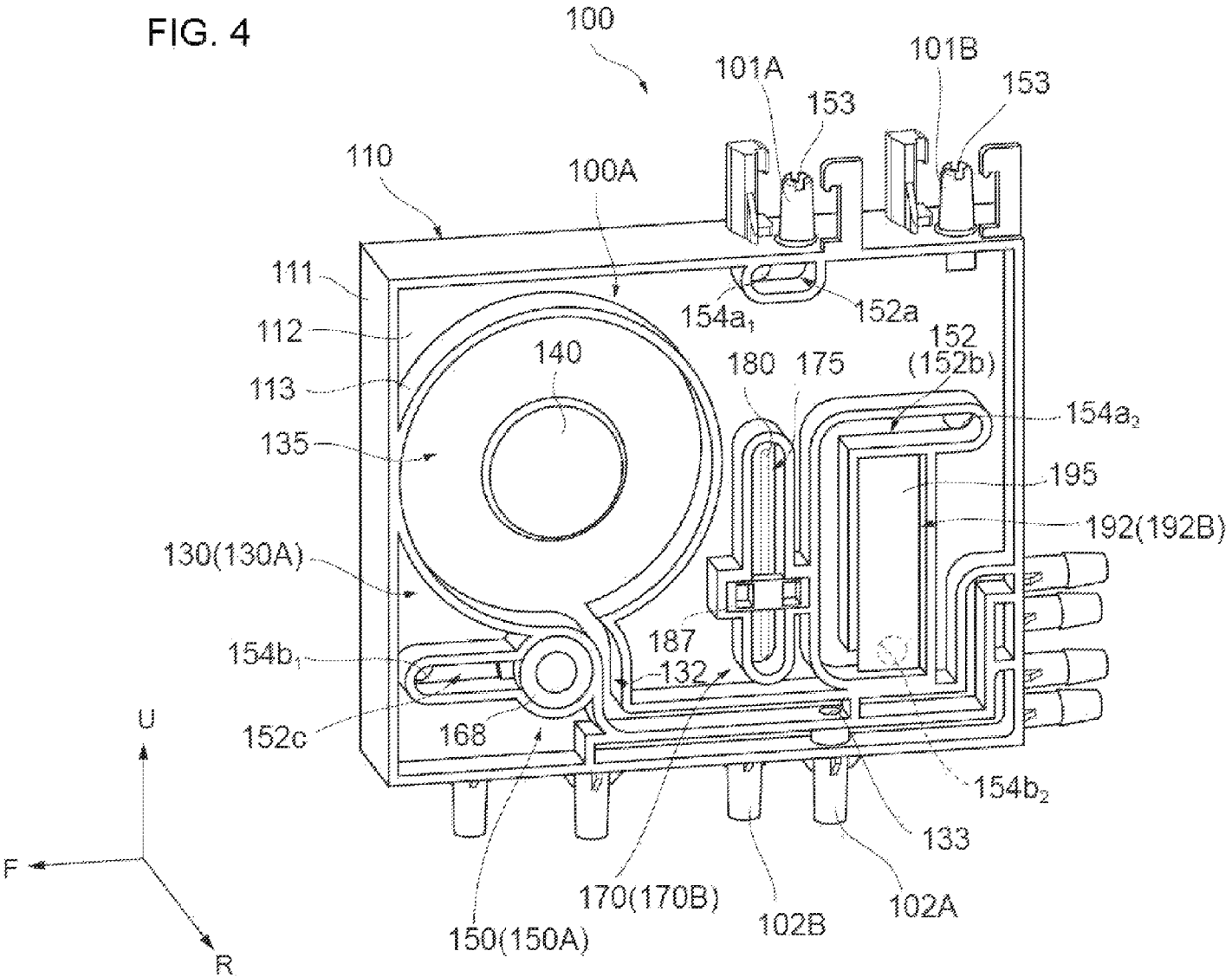
FIG. 4 is a perspective view of one side face of a casing with a film that covers the side face removed to show an internal structure.
Figure 5:
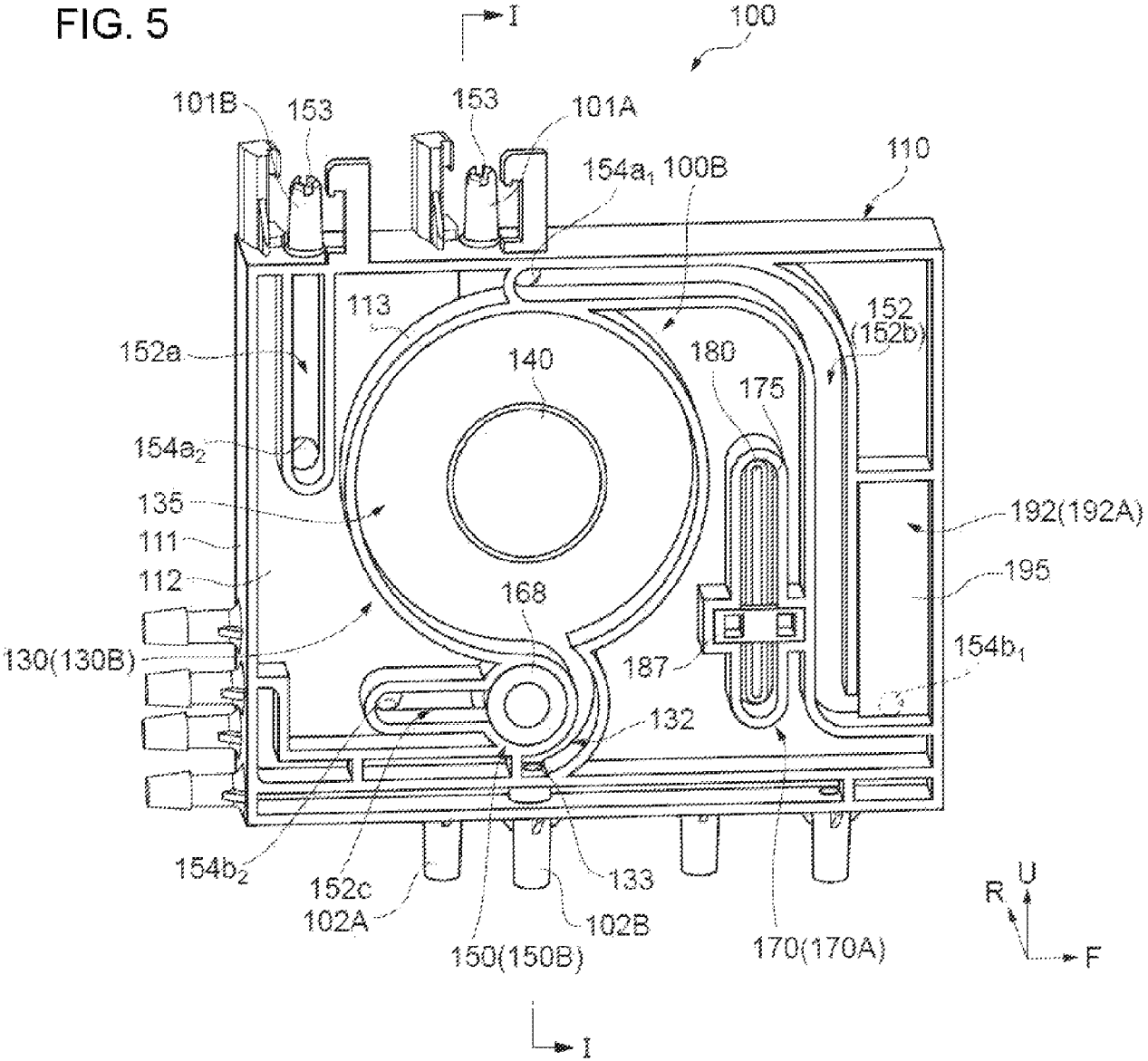
FIG. 5 is a perspective view of other side face of the casing with the film that covers the side face removed to show an internal structure.
Figure 6:
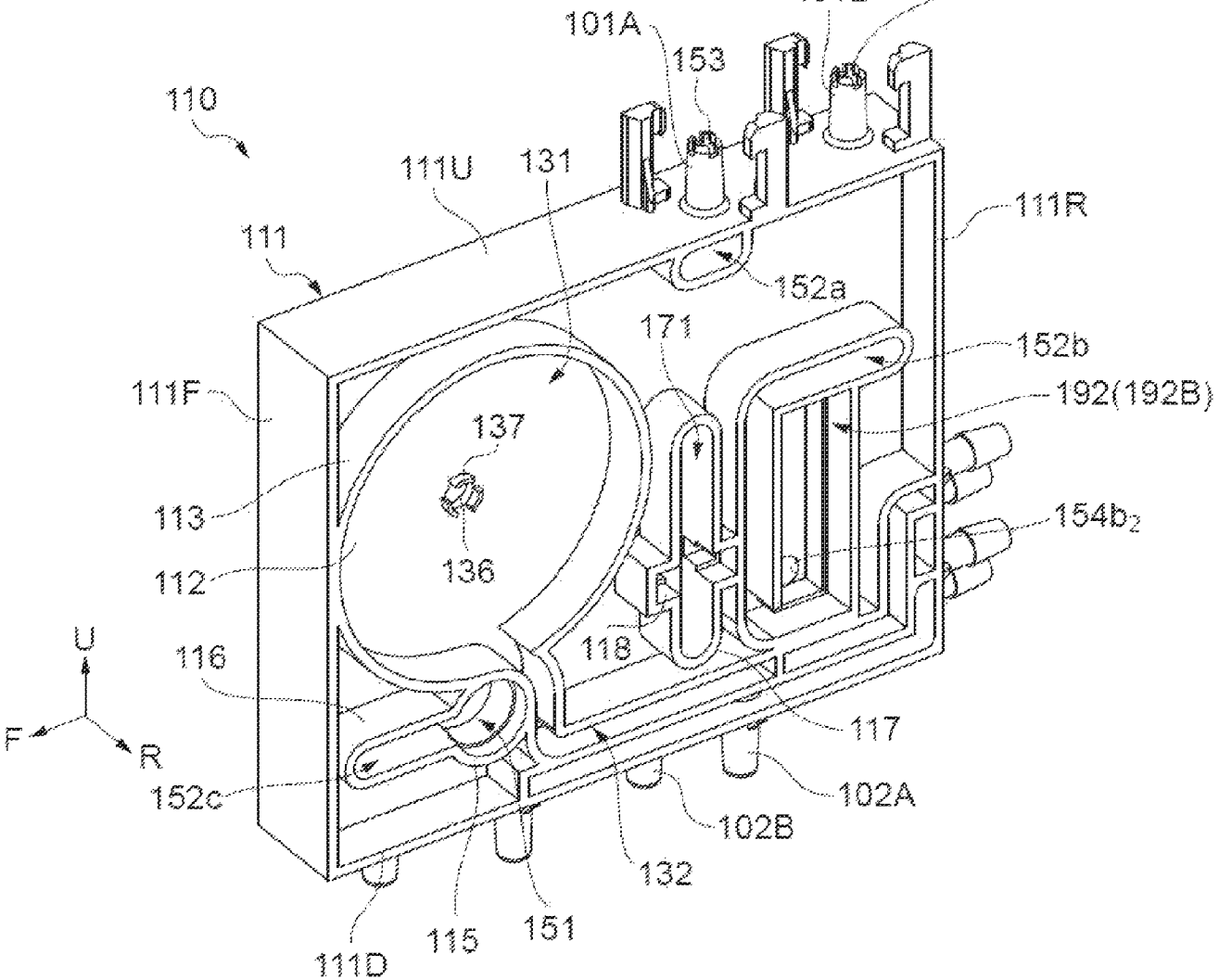
FIG. 6 is a perspective view showing a structure of the casing on the one side face.
Figure 7:
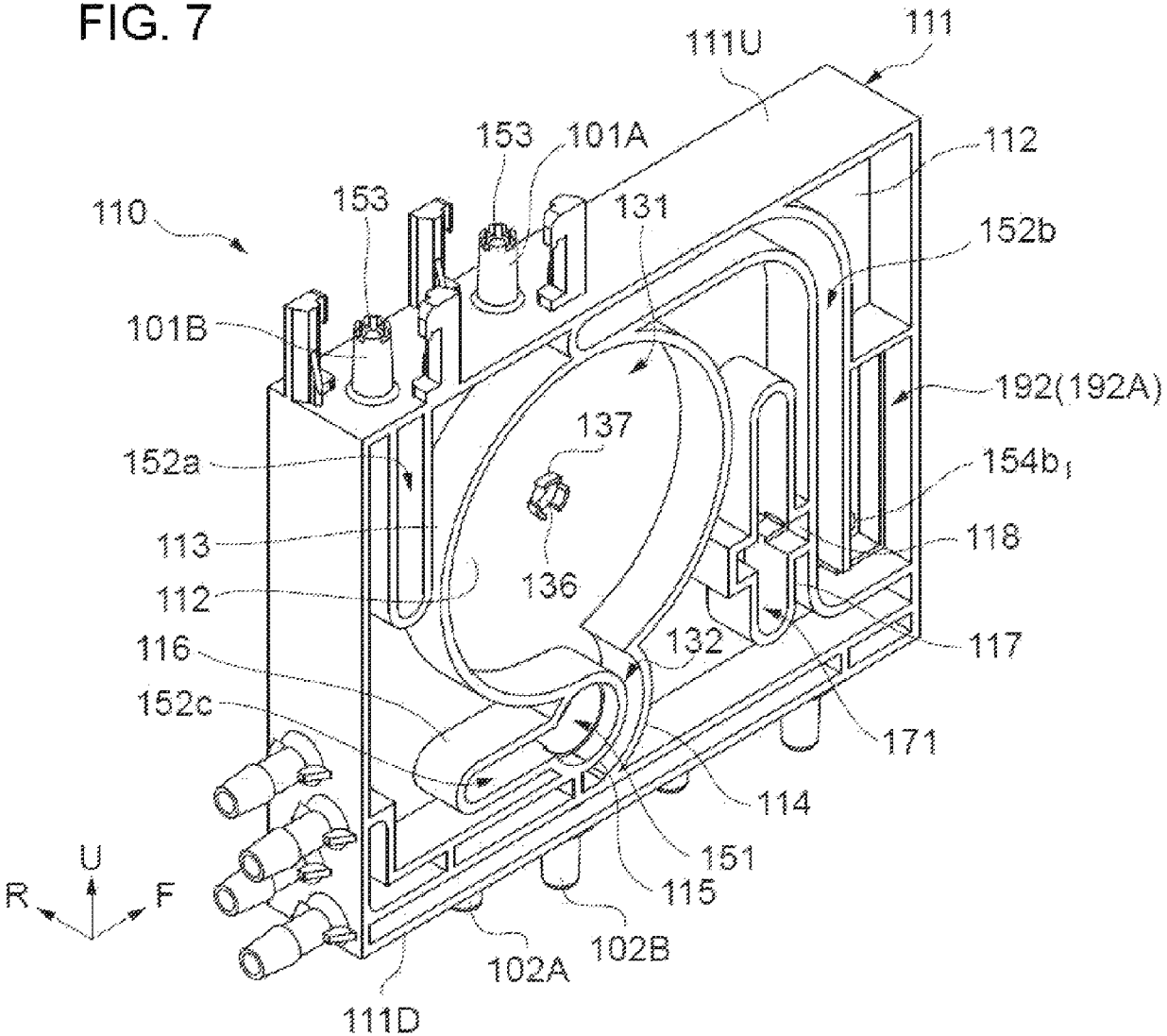
FIG. 7 is a perspective view showing a structure of the casing on the other side face.

FIG. 1 and FIGS. 4 to 7 are drawings of a structure of the pressure regulating valve 100. FIG. 1 is a typical sectional view (along arrows I-I of FIG. 5) showing a principal structure of the pressure regulating valve 100. FIGS. 4 and 5 are perspective views of an internal structure on one side and other side when a film covering the side surfaces of a casing is removed. FIGS. 6 and 7 are perspective views of structures of the casing on one side and the other side. For the sake of simplicity, in the explanation hereafter, arrows F, R, and U shown in each of these drawings will indicate front, right, and up directions, respectively. The pressure regulating valve 100 can be arranged in any appropriate orientation other than vertical.

The pressure regulating valve 100 includes a casing 110 that serves as a base, a negative pressure generating unit 130 that is provided in the casing 110 and is connected to the print head 35, a sealing valve 150 that is provided in the casing 110 and is connected to the ink tank 18, and a linkage mechanism 170 that links the negative pressure generating unit 130 and the sealing valve 150.

The casing 110, when viewed from a left side or a right side, has an external shape of a laterally elongated rectangle having outer walls 111 (upper outer wall 111U, lower outer wall 111D, front outer wall 111F, and rear outer wall 111R) above, below, in front, and rear, and forming a thin rectangular box. A partition wall 112 provided in a space in the thickness direction divides the rectangular box into two-layer structure with a front layer and a back layer (arranged horizontally).

The pressure regulating valve 100, by virtue of this two-layer structure, appears to behave like two units of the pressure regulating valve, each of which includes its respective negative pressure generating unit 130, the sealing valve 150, and the linkage mechanism 170. To differentiate between the two units of the pressure regulating valve, reference symbol A is used to denote a first pressure regulating unit 100A and its constituent members, for example, a negative pressure generating unit 130A, etc., and reference symbol B is used to denote a second pressure regulating unit 100B and its constituent members, for example, a negative pressure generating unit 130B, etc.

On a right face side (one side face) of the partition wall 112 of the casing, the negative pressure generating unit 130A of the first pressure regulating unit 100A lies in a front upper portion, a sealing valve 150A of the first pressure regulating unit lies below the negative pressure generating unit 130A, a linkage mechanism 170B of the second pressure regulating unit 100B lies anteroposteriorly in a space adjacent to the negative pressure generating unit 130A and the sealing valve 150A, and a filter chamber 192B of the second pressure regulating unit 100B lies in a rear portion.

On a left face side (other side face) of the partition wall 112 of the casing, the negative pressure generating unit 130B of the second pressure regulating unit 100B lies in the rear upper portion, a sealing valve 150B of the second pressure regulating unit 100B lies below the negative pressure generating unit 130B, a linkage mechanism 170A of the first pressure regulating unit 100A lies anteroposteriorly in a space adjacent to the negative pressure generating unit 130B and the sealing valve 150B, and a filter chamber 192A of the first pressure regulating unit 100A lies in a front portion.

The negative pressure generating unit 130 (130A and 130B) is connected to the print head 35, and includes a negative pressure chamber 135 formed by a first depressed portion 131 laid out in the casing 110 and a film 134 that covers the first depressed portion 131, a pressure receiving member 140 that is bonded to the film 134, and a pressure receiving and biasing spring 145 that biases the pressure receiving member 140 outwardly from the negative pressure chamber 135.

Apart from a large-diameter first depressed portion 131 that is demarcated by a substantially circular surrounding wall 113 rising from the partition wall 112 and that is of the same height as the outer wall, the casing 110 has formed therein, an ink lead-out channel 132 that is connected to the first depressed portion 131 and is formed by a pair of passageway walls 114 that run parallel to each other downward from a lower edge of the surrounding wall 113, and an ink lead-out port 133 that penetrates through the output port 102 that is protrudingly formed in the lower outer wall 111D and connects with the ink lead-out channel 132 (see FIG. 1). Once the film 134 is welded to the side surface of the casing 110, the negative pressure chamber 135 is formed by the first depressed portion 131 and the film 134 that covers an opening surface of the first depressed portion 131, and the ink lead-out channel 132 that connects the negative pressure chamber 135 and the output port 102 is formed. The negative pressure chamber 135 is connected to the print head 35 via the head supply line 22 that is connected to the output port 102.

For example, on the right face side of the casing 110 (see FIG. 4), the negative pressure chamber 135 of the negative pressure generating unit 130A belonging to the first pressure regulating unit 100A is formed. This negative pressure chamber 135 is connected to a first nozzle row (not shown) of the print head 35 via the ink lead-out channel 132 on the right face side, the ink lead-out port 133 that penetrates through an output port 102A of the first pressure regulating unit 100A, and the head supply line 22 that is connected to the output port 102A. Similarly, on the left side surface of the casing 110 (see FIG. 5), the negative pressure chamber 135 of the negative pressure generating unit 130A belonging to the second pressure regulating unit 100B is formed. This negative pressure chamber 135 is connected to a second nozzle row (not shown) of the print head 35 via the ink lead-out channel 132 on the left face side, the ink lead-out port 133 that penetrates through an output port 102B of the second pressure regulating unit 100B, and the head supply line 22 that is connected to the output port 102B. Moreover, the negative pressure chamber 135 of the first pressure regulating unit 100A and the negative pressure chamber 135 of the second pressure regulating unit 100B can be connected to different print heads.

The pressure receiving member 140 is an overall thin disc-shaped member with a diameter that is somewhat smaller than that of the first depressed portion 131. A rod-shaped pressure conveying unit 141 is protrudingly formed in the central portion of a back surface side of the pressure receiving member 140. An annular spring supporting unit 142 that holds an outer peripheral side of the pressure receiving and biasing spring 145 is arranged on an outer peripheral side of the pressure conveying unit 141 to prevent the pressure receiving and biasing spring 145 from shifting. The film 134 is made of a thin, transparent film material (for example, a laminate film of polypropylene and polyethylene), and is liquid-tight as well as air-tight. The pressure receiving member 140 is integrally joined to the film 134 by way of adhesion, such as, by welding.

At the center of the first depressed portion 131 that opposes the pressure receiving member 140, a first opening 136 that has a larger diameter than the pressure conveying unit 141 penetrates through the partition wall 112. A spring supporting unit 137 that consists of a plurality of short arc-shaped protrusions (in the present embodiment, three short arc-shaped protrusions that are arranged at equal angular pitch) is formed in the first depressed portion around the first opening 136. The spring supporting unit 137 holds an inner peripheral side of the pressure receiving and biasing spring 145 to prevent the pressure receiving and biasing spring 145 from shifting. The pressure receiving and biasing spring 145 that is made from a compressed coil spring stretches between the spring supporting unit 137 on the partition wall 112 side and the spring supporting unit 142 on the pressure receiving member 140 side, and biases the pressure receiving member 140 outwardly from the negative pressure chamber 135, pressing and causing the film 134 to stretch laterally from the casing 110. The pressure receiving and biasing spring 145 is made of other biasing tools such as a leaf spring or a torsion spring.

The negative pressure generating unit 140 is formed by engaging the pressure receiving and biasing spring 145 to the spring supporting unit 137 on the partition wall 112 side, taking the film 134 with the integrally joined pressure receiving member 140 over the pressure receiving and biasing spring 145 to cover the first depressed portion 131, and welding the film 134 to end surfaces of the surrounding wall 113 and the passageway walls 114 with the pressure conveying unit 141 positioned at the center of the first depressed portion 131. The film 134 is stretched over and welded in such a way that, upon being pressed against by the pressure receiving and biasing spring 145, the film 134 is able to stretch outwardly from a side edge face of the casing 110 by a predetermined distance (for example, about 1 millimeter (mm)), and when the pressure receiving member 140 is pressed inwardly into the negative pressure chamber 135, opposing the urging force of the pressure receiving and biasing spring 145, the film 134 loosens to bend inwardly into the negative pressure chamber 135 by a predetermined distance (for example, about 1 mm) from the side edge face of the casing 110 (see FIGS. 8A and 8B). In other words, the film 134 is stretched over and welded in such a way as to allow it enough leeway to bend by a certain distance inwardly into the negative pressure chamber 135 and outwardly away from the negative pressure chamber 135 (horizontally in FIGS. 4 to 7). The film 134 is welded after the sealing valve 150 and the linkage mechanism 170, described later, have been assembled.

Once the negative pressure generating unit 130 is formed, the pressure receiving member 140 is positioned at the center of the negative pressure chamber 135 with the pressure conveying unit 141 lying coaxially with the first opening 136, and is arranged displaceable in an axial direction (horizontal direction). When the pressure receiving member 140 is biased outwardly from the negative pressure chamber 135 by the pressure receiving and biasing spring 145 in an open state with no external force at play, the film 134 remains bulging outward from the casing 110. The sealing valve 150 is arranged below the negative pressure generating unit 130.

The sealing valve 150 (150A and 150B) includes a pressure chamber 155 that is connected to the ink tank 18 and is formed by a second depressed portion 151 laid out in the casing 110 demarcated by a surrounding wall 115 and the film 134 that covers the second depressed portion 151, a valve element 160 that opens and closes a second opening 156 provided in the pressure chamber 155, a valve biasing spring 165 that biases the valve element 160 toward a closing direction, etc.

The second depressed portion 151 is demarcated by the substantially circular surrounding wall 115 rising from the partition wall 112 below the first depressed portion 131 and is formed in a cylindrical shape with a smaller diameter than that of the first depressed portion 131. A third lead-in channel 152*c* extends from the side of the second depressed portion 151 forming a keyhole shape with the second depressed portion 151. The third lead-in channel 152*c* is demarcated by a passageway wall 116 that is connected to the surrounding wall 115 and extends horizontally. The third lead-in channel 152*c* is connected to a filter chamber 192 provided on the other side face of the casing 110 via a connection opening 154*b* (154$b_1$ and 154$b_2$) that penetrates through the partition wall 112. The third lead-in channel 152*c* is also connected, via a second lead-in channel 152*b* formed on the side of the filter chamber 192 and a connection opening 154*a* (154$a_1$ and 154$a_2$) that penetrates through the partition wall 112 above the second lead-in channel 152*b*, to an ink lead-in port 153 that penetrates through a first lead-in channel 152*a* provided on one side face of the casing and the input port 101 that is protrudingly formed in the upper outer wall 111U, and communicates with the first lead-in channel 152*a*.

Once the film 134 is welded to both the side surfaces of the casing 110, the pressure chamber 155 is formed by the second depressed portion 151 and the film 134 that covers the second depressed portion, and an ink lead-in channel 152, consisting of the first lead-in channel 152*a*, the second lead-in channel 152*b*, and the third lead-in channel 152*c*, that connects the pressure chamber 155 and the ink lead-in port 153 of the input port 101 is formed. The pressure chamber 155 is connected to the ink tank 18 via the ink tube 21 that is connected to the input port 102.

The above-mentioned structure is explained below specifically with respect to the first pressure regulating unit 100A on the right face side of the casing 110 in which the sealing valve 150A is provided. The third lead-in channel 152*c* that extends toward the front from the pressure chamber 155 is connected to the first ink tank 18 fitted in the cartridge mounting unit 16 via the second lead-in channel 152*b* that is connected to the filter chamber 192A provided on the left face side of the casing 110 through the connection opening 154$b_1$ provided on a front end side of the third lead-in channel 152*c*, and extends parallel to the upper outer wall 111U toward the rear through a side of the filter chamber 192A, the first lead-in channel 152*a* provided above the right surface of the casing through the connection opening 154$a_1$ formed on a rear end of the second lead-in channel 152*b*, and the ink lead-in port 153 that penetrates through an input port 101A of the first pressure regulating unit 100A, provided protrudingly in the upper outer wall 111U, and the ink tube 21 that is connected to the input port 101A.

The above-described structure holds true for the second pressure regulating unit 100B on the left face side of the casing 110 in which the sealing valve 150B is provided. That is, the pressure chamber 155 is connected to a second ink tank fitted in the cartridge mounting unit 16 via the ink lead-in channel 152 consisting of the third lead-in channel 152*c*, the second lead-in channel 152*b*, and the first lead-in channel 152*a* that are connected by the connection openings 154$b_2$ and 154$a_2$, respectively, the filter chamber 192B arranged between the third lead-in channel 152*c* and the second lead-in channel 152*b*, the ink lead-in port 153 that penetrates through an input port 101B of the second pressure regulating unit 100B, provided protrudingly in the upper outer wall 111U, and the ink tube 21 that is connected to the input port 101B. An ink tank that stores an ink of the same color as the first ink tank is typically connected as the second ink tank. However, because the first pressure regulating unit 100A and the second pressure regulating unit 100B are completely independent units, ink tanks that contain inks of different colors can be connected.

As explained above, the pressure chamber 155 is formed in a substantially cylindrical shape of a small diameter. At the bottom of the pressure chamber 155, the second opening 156 penetrates through the partition wall 112 (see FIG. 1). A disc-shaped damper seal member 157 having a rubber elasticity and with an opening at the center thereof that is substantially of the same diameter as that of the second opening 156 is provided as a valve seat at the bottom of the pressure chamber 155. A cylindrical retainer ring 158 is provided in the outer periphery of the damper seal member 157 to pin down the damper seal member 157 and prevent it from lifting. The retainer ring 158 also supports an outer periphery of the valve element 160, as explained next, to enable smooth sliding of the valve element 160. A cutout (not shown) is provided on the peripheral surface of the retainer ring 158 at the position that coincides (horizontal direction position) with the third lead-in channel 152*c* to enable resistance-free flow of the ink from the third lead-in channel 152*c* through the cutout into the pressure chamber 155.

The sealing valve 150 has the following structure. The valve element 160 is accommodated within the cylindrical retainer ring 158, and an end cap 168 is press-fitted blocking an end that opens into the second depressed portion 151, with the valve biasing spring 165 biasing the valve element 160 toward the partition wall 112. The valve element 160 includes a valve plate 161 that has a shape of a thin disc of a somewhat smaller outer diameter than the retainer ring 158, and a lug 162 that extends from the center of the valve plate 161 and that has a smaller diameter than the second opening 156. A spring supporting unit 163 that consists of a plurality of short arc-shaped protrusions on the outer periphery of the valve biasing spring 165 is provided on the back surface side of the valve plate 161. On an inner surface side of the end cap 168 also, a spring supporting unit that holds the outer periphery of the valve biasing spring 165 is formed on a concave groove.

A compressed coil spring is used as the valve biasing spring 165. The valve biasing spring 165 is sandwiched between the spring supporting unit 163 on the valve element 160 side and the spring supporting unit on the end cap 168 side. The valve biasing spring 165 is always biased toward the bottom of the pressure chamber 155, bringing the valve element 160 in close contact with the damper seal member 157. Due to this, when no external force is acting on the valve element 160, the valve plate 161 is pressed against the damper seal member 157 by the urging force of the valve biasing spring 165. As a result, the valve element 160 is maintained in the closed-valve state in which the second opening 156 is sealed and the communication with the pressure chamber 155 is blocked. On the other hand, when the valve element 160 is moved opposing the urging force of the valve biasing spring 165, the valve plate 161 is moved away from the damper seal member 157, freeing the second opening 156 and restoring communication with the pressure chamber 155. The ink in the pressure chamber 155 then flows through the second opening 156 to the other side face across from the partition wall 112. The linkage mechanism 170 is provided on the other side face across from the partition wall 112.

The linkage mechanism 170 (170A and 170B) includes a communication flow chamber 175 formed by a concave groove 171 in the casing 110 demarcated by a surrounding wall 117, and the film 134 that covers the concave groove 171 and that interconnects the first opening 136 that communicates with the negative pressure chamber 135 and the second opening 156 that communicates with the pressure chamber 155, and an operating lever 180 that includes a first engagement section 181, that engages with and disengages from the pressure receiving member 140, provided at one end of an arm section, a second engagement section 182, that engages with and disengages from the valve element 160, provided at other end of the arm section, and a swinging fulcrum 183 between the first engagement section 181 and the second engagement section 182. The operating lever 180 is swingably arranged inside the communication flow chamber 175.

Thus, the linkage mechanism 170 is provided across the partition wall 112 from the pressure chamber 155 and the negative pressure chamber 135. In other words, in the pressure regulating valve 100 according to the present embodiment, the linkage mechanism 170A of the first pressure regulating unit 100A is provided on the left face side of the casing 110, and the linkage mechanism 170B of the second pressure regulating unit 100B is provided on the right face side of the casing 110. The concave groove 171 in which the linkage mechanism is accommodated is demarcated by the surrounding wall 117 rising from the partition wall 112 and is of the same height as the outer wall 111. The concave groove 171 is a vertically oblong groove and is separated from its surroundings. An upper end of the concave groove 171 is formed integrally with the first opening 136 that is connected to the negative pressure chamber 135 while a lower end of the concave groove 171 is formed integrally with the second opening 156 that is connected to the pressure chamber 155, thus forming a communication between the first opening 136 and the second opening 156. Therefore, the communication flow chamber 175 that interconnects the first opening 136 and the second opening 156, and allows the ink to flow through is formed by welding the film 134 covering the concave groove 171 to the end surfaces of the surrounding wall 117.

Figure 9:
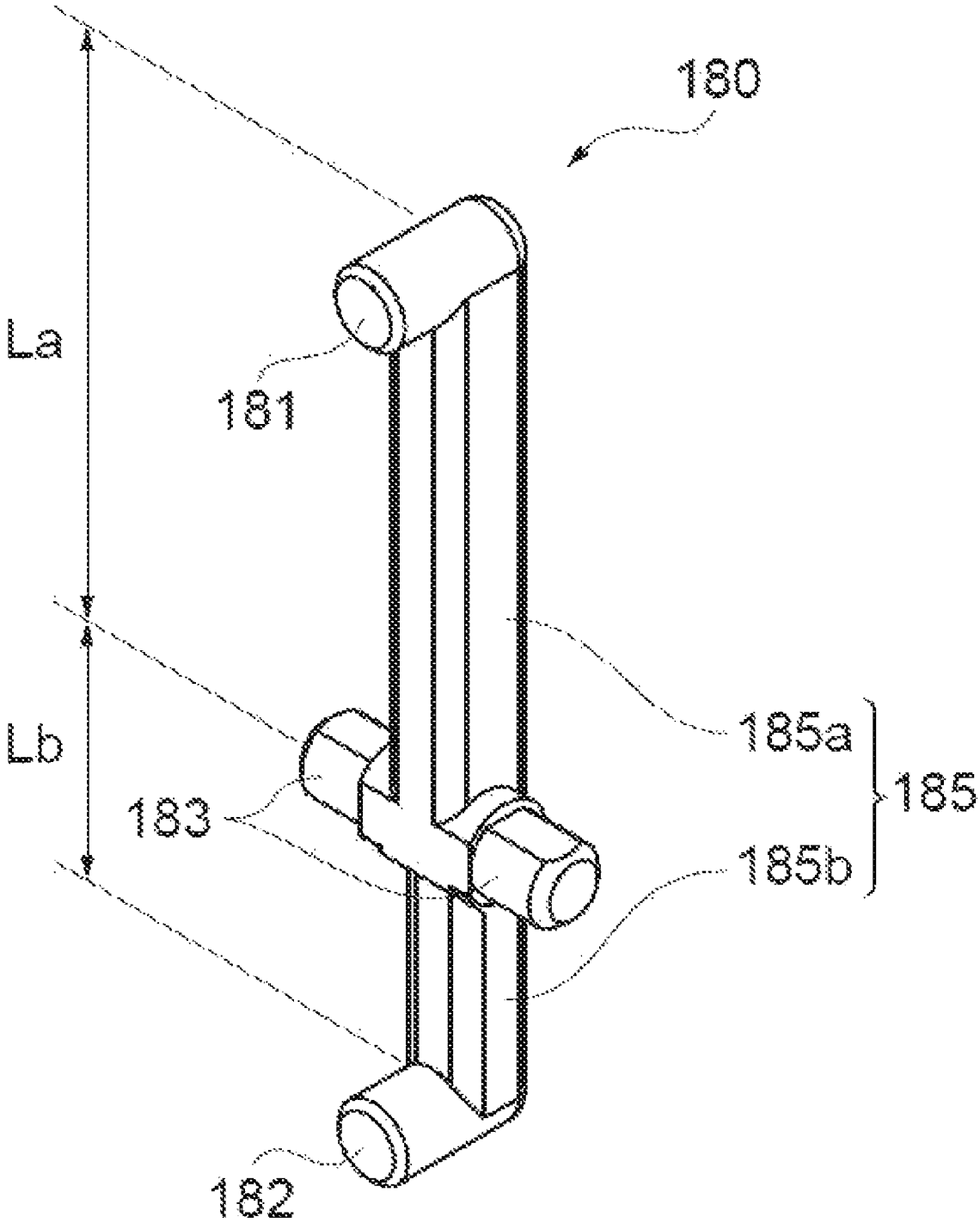
FIG. 9 is a perspective view of an operating lever constituting a linkage mechanism.

Between the first opening 136 and the second opening 156, the surrounding wall 117 extends outwardly from the communication flow chamber 175 on the front as well as the rear, forming opposing box shaped seats 118 and 118. The swinging fulcrum 183 of the operating lever 180 is supported by the seats 118. As shown in a perspective view of the operating lever 180 in FIG. 9, the operating lever 180 includes an arm section 185 that extends vertically, a short cylindrical first engagement section 181 that protrudes to the front from the upper end of the arm section 185 orthogonal to an extension direction of the arm section 185, a short cylindrical second engagement section 182 that protrudes to the front from the lower end of the arm section 185 orthogonal to the extension direction of the arm section 185, and short cylindrical swinging fulcrums 183 and 183 that protrude to the right and left and that are located between the first and second engagement sections orthogonal to the extension direction of the arm section 185 as well as a protrusion direction of the first and second engagement sections.

The swinging fulcrum 183 is formed closer to the second engagement section of the arm section 185. A length La of a first arm section 185*a* between the swinging fulcrum 183 and the first engagement section 181 is set greater than a length Lb of a second arm section 185*b* between the swinging fulcrum 183 and the second engagement section 182. Specifically, in the present embodiment, the length La of the first arm section 185*a* is set twice the length Lb of the second arm section 185*b*. That is, La:Lb=2:1. The seat 118 that swingably supports the operating lever 180 is also formed to match the length ratio of the lengths of the first arm section 185*a* and the second arm section 185*b*. The operating lever 180 is inserted into the concave groove 171 with the swinging fulcrums 183 and 183 supported in the seats 118 and 118, and the swinging fulcrums 183 and 183 are covered by fastening a damper link stopper 187. In this manner, the operating lever 180 is supported within the concave groove 171 to be swingable vertically. In this state, the first engagement section 181 of the operating lever is in alignment with the first opening 136, and positioned to be engagable to and disengagable from the pressure conveying unit 141 of the pressure receiving member 140, and the second engagement section 182 of the operating lever is in alignment with the second opening 156, and positioned to be engagable to and disengagable from the lug 162 of the valve element 160.

Thereafter, a filter 195 is fitted in the filter chamber 192 (192A and 192B) and the entire outer wall 111 (111U, 111D, 111F, and 111R) that includes the surrounding wall 117 is covered by the film 134 and the film 134 is welded to end surfaces of the walls. In this way, the communication flow chamber 175 that interconnects the first opening 136 and the second opening 156 is formed, and the linkage mechanism 170 (170A and 170B) is constituted. In addition, the above-described negative pressure generating unit 130 (130A and 130B), and the sealing valve 150 (150A and 150B) are constituted, and the pressure regulating valve 100 consisting of the pressure regulating units 100A and 100B is constituted.

Figure 8A:
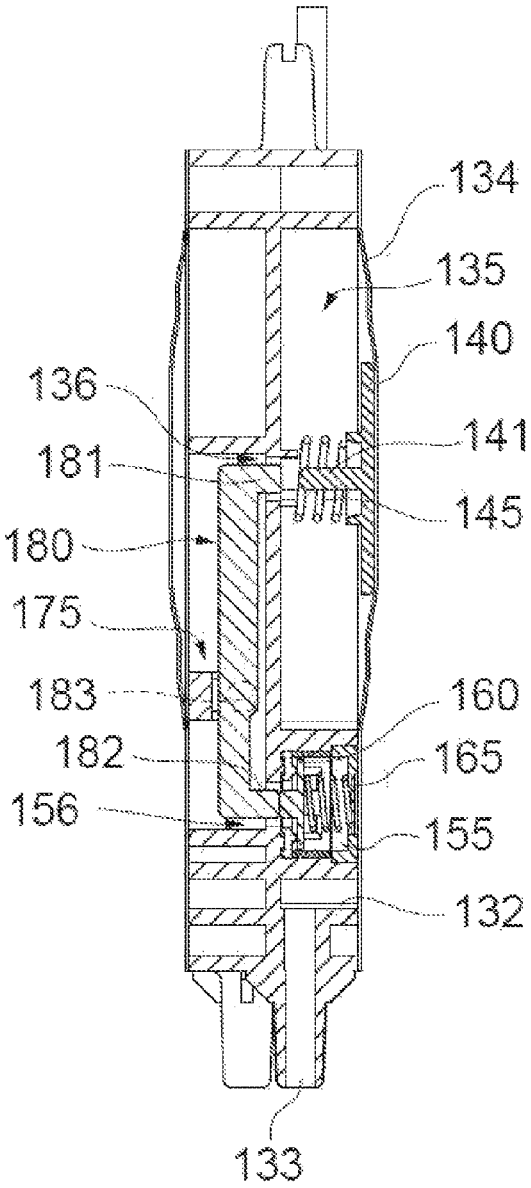
FIGS. 8A and 8B are sectional views similar to that of FIG. 1 to illustrate a pressure receiving member stretched outwardly from a negative pressure chamber (FIG. 8A), and drawn inwardly into the negative pressure chamber (FIG. 8B)
Figure 8B:
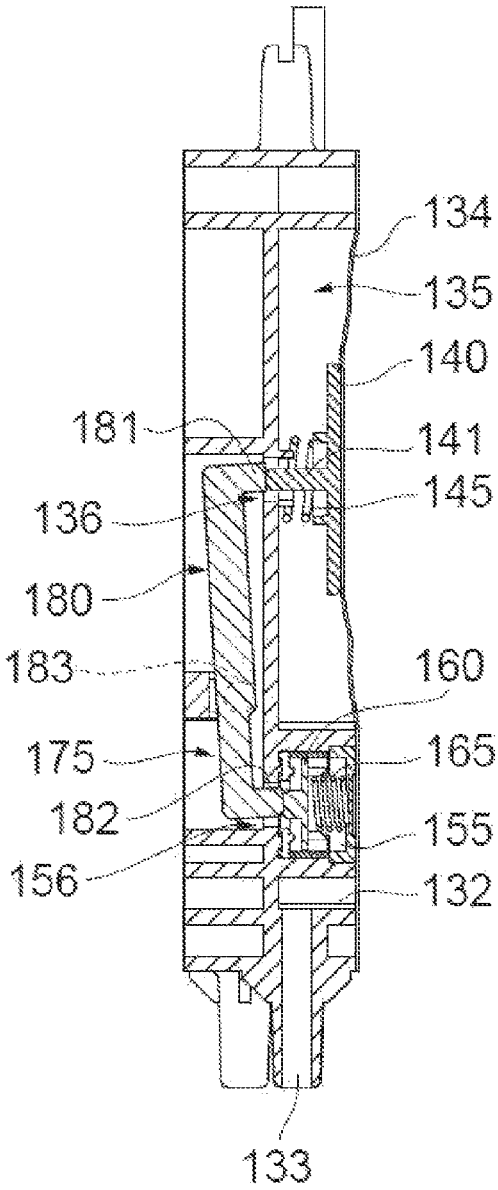

How the pressure regulating valve 100 constituted as described above is used is explained next by taking the pressure regulating unit 100A as an example. The ink tank 18 is connected to the input port 101A of the pressure regulating unit 100A via the ink tube 21 and the print head 35 is connected to the output port 102A via the head supply line 22. FIGS. 8A and 8B are sectional views similar to that of FIG. 1 to illustrate the pressure receiving member 140 stretched outwardly from the negative pressure chamber 135 (FIG. 8A), and drawn inwardly into the negative pressure chamber 135 (FIG. 8B).

The ink supplied from the ink tank 18 to the input port 101A via the ink tube 21 is led into the casing from the ink lead-in port 153 formed in the input port 101A, and from the first lead-in channel 152*a* enters the filter chamber 192A through the connection opening 154$a_1$ and the second lead-in channel 152*b*. The ink filtered by the filter 195 is led into the pressure chamber 155 of the sealing valve 150A through the connection opening 154$b_1$ and the third lead-in channel 153*c*. During the initial filling of the ink, due to an ink suction action of the nozzle surface, a negative pressure is created in the negative pressure chamber 135, and the sealing valve 150A is opened. As a result, the ink in the pressure chamber 155 flows into the communication flow chamber 175 through the second opening 156, and into the negative pressure chamber 135 through the first opening 136 in an upper end of the communication flow chamber 175. The ink in the negative pressure chamber 135 flows down the ink lead-out channel 132, and is supplied to the print head 35 from the ink lead-out port 133 formed in the output port 102A through the head supply line 22.

In this way, when the ink supply channel 20 from the ink tank 18 to the print head 35 is filled with ink, and the ink suction action stops, the pressure at the nozzle surface 35*a* of the print head 35 changes to the atmospheric pressure, and the pressure inside the negative pressure chamber 135 rises. Consequently, the pressure receiving member 140 that receives the urging force of the pressure receiving and biasing spring 145 is moved outwardly from the negative pressure chamber 135 while causing the film 134 to bulge, and the pressure conveying unit 141 is moved away from the first engagement section 181. As a result, the operating lever 180 receives the urging force of the valve biasing spring 165 via the second engagement section 182 and the valve element 160, and swings clockwise in FIG. 1 and causes the valve plate 161 to come in close contact with the damper seal member 157, and the sealing valve 150A closes (see FIG. 8A).

When the sealing valve 150A closes, the ink supply channel 20 is blocked at the point where the valve element 160 is located, and the ink further downstream than the valve element 160 in the flow channel remains trapped inside the flow channel due to a capillary action. At this point, the pressure receiving member 140 is biased outwardly from the negative pressure chamber 135 by the pressure receiving and biasing spring 145, and the film 134 is press-forced in a direction (stretching direction) that causes a volume of the negative pressure chamber 135 to expand. Due to this, the ink further downstream than the valve element 160 in the flow channel is subjected to a negative pressure that is required for the ink to be sucked into the negative pressure chamber 135. Thus, instead of a pressure corresponding to a head differential with the ink tank 18, a marginally negative pressure corresponding to the urging force of the pressure receiving and biasing spring 145 acts on the print head 35, and a meniscus is formed on the nozzle surface.

When a discharge of the ink begins from the nozzles of the print head 35 with the initiation of drawing by the printer device P, the ink stored in the negative pressure chamber 135 is consumed depending on the discharge of the ink, and the pressure in the negative pressure chamber 135 gradually falls according to the consumption of the ink. Meanwhile, a differential pressure between the atmospheric pressure and the pressure inside the negative pressure chamber as well as a pressure corresponding to a pressure receiving surface area act on the pressure receiving member 140 that is subjected to the atmospheric pressure via the film 134, and the pressure receiving member 140 remains at a position where this pressure and the urging force of the pressure receiving and biasing spring 145 balance each other out. Consequently, with the consumption of the ink, the pressure receiving member 140 is moved inwardly into the negative pressure chamber 135, the pressure conveying unit 141 engages with the first engagement section 181 of the operating lever and causes the operating lever 180 to swing counter-clockwise in FIG. 1, and the second engagement section 182 that is engaged in the lug 162 is pressed against the valve element 160.

As a pressing force on the valve element 160 increases and a valve element closing force (valve opening threshold value) is exceeded due to the valve biasing spring 165, the valve element 160 is moved in the valve opening direction opposing the urging force of the valve biasing spring 165, and the valve plate 161 is moved away from the damper seal member 157, opening the sealing valve 150A (see FIG. 8B).

The pressure regulating valve 100 has a structure such that the pressure acting on the pressure receiving member 140 is conveyed to the valve element 160 via the operating lever 180, and the length La of the first arm section 185*a* on the pressure receiving member 140 side on one side of the swinging fulcrum 183 of the operating lever 180 is set greater than the length Lb of the second arm section 185*b* on the valve element 160 side. Due to this, the force conveyed from the pressure receiving member 140 to the operating lever 180 is amplified according to the ratio La:Lb of the lengths La and Lb of the first arm section 185*a* and the second arm section 185*b*, respectively, by the so-called principle of leverage. That is, if La:Lb=2:1, the force acting on the operating lever 180 from the pressure receiving member 140 is doubled before being conveyed to the valve element 160.

Therefore, the sealing valve 150 can be opened and closed at a substantially constant negative pressure range without having to change the size of the pressure regulating valve by increasing the surface area of the pressure receiving surface of the negative pressure chamber to accommodate variations in the valve opening threshold value due to variations in the valve biasing spring 165, variations in the urging force due to precision of dimensions or precision in the assembly of the parts constituting the sealing valve 150, deformation and wear of the damper seal member 157, sticking together of the valve element 160 and the damper seal member 157, variation in the pressure inside the pressure chamber 155 due to variations in the fluid level and pressure of the ink on the ink tank 18 side, etc., and tolerance levels (margins) of the variations mentioned above can be increased. Furthermore, because the pressure in the negative pressure chamber 135 is magnified by the operating lever 180, the pressure in the negative pressure chamber 135 can be set higher (closer to atmospheric pressure) than the conventionally allowed predetermined pressure, making it possible to provide a pressure regulating valve capable of supplying the ink stably at a high head supply pressure that does not cause the meniscus to be lost.

When the sealing valve 150A opens in this manner, the pressure chamber 155 and the communication flow chamber 175 communicate via the second opening 156, and the ink in the pressure chamber 155 flows into the negative pressure chamber 135 through the second opening 156, the communication flow chamber 175, and the first opening 136. Due to this, the pressure inside the negative pressure chamber 135 rises, the pressure receiving member 140 is moved due to the urging force of the pressure receiving and biasing spring 145 while stretching the film 134, and the valve element 160 is moved in the valve closing direction while causing the operating lever 180 to swing due to the urging force of the valve biasing spring 165. The valve plate 161 of the valve element 160 then comes in close contact with the damper seal member 157 and the sealing valve 150A is closed. Due to the blocking of the ink supply channel 20, a marginally negative pressure is maintained in the flow path further downstream than the valve element 160.

Thus, the flow path on the print head side further downstream than the valve element 160 is always maintained at a marginally negative pressure favorably suited for ink discharge, and the ink is supplied to the negative pressure chamber 135 according to the consumption of the ink discharged from the print head 35. The same action also holds true for the second pressure regulating unit 100B.

In the pressure regulating valve 100, the negative pressure generating unit 130 and the sealing valve 150 of each pressure regulating unit are provided on one side face of the casing 110, while the linkage mechanism 170 is provided on the other side face of the casing 110 across from the partition wall 112. Thus, the pressure regulating valve is provided with the linkage mechanism 170 such that both the front and the rear of a single casing 110 are effectively utilized. By this, the pressure regulating valve having a simple structure but equipped with a boosting function due to the linkage mechanism 170 is provided without having to provide multiple layers of the casing or complicating the die.

Furthermore, the first pressure regulating unit 100A and the second pressure regulating unit 100B are provided on each side face on either side of the partition wall 112 in a reverse relation, that is, back to back on either side of the partition wall 112, on the front and the rear of the casing 110. Consequently, a space occupied by the pressure regulating valve can be halved, a leeway can be provided on a space-constrained carriage, and a moving mass of the carriage can be reduced. Thus, the printer device with a compact driving system but that can move at high speeds can be obtained. Furthermore, as already explained with reference to the drawings, the negative pressure chamber 135 of the first negative pressure generating unit 130A, and the negative pressure chamber 135 of the second negative pressure generating unit 130B are provided on either side of the partition wall 112 on the front and the rear of the casing 110 in such a way as to partially overlap with each other. Thus, the area occupied by the negative pressure chamber 135, which characteristically occupies the maximum area in the pressure regulating valve for the inkjet printer, can be reduced by the length of the overlapping area, and the pressure regulating valve consisting of two independent units can be made further compact.

In the above-explained embodiment, the sealing valve 150 consists of the damper seal member 157 and the valve element 160 formed as separate entities. However, the damper seal member 157 can be bonded to or welded to the valve element 160, or the damper seal member 157 and the valve element 160 can be formed as an integrated unit by using a mold, etc. Furthermore, the length La of the first arm section 185*a* and the length Lb of the second arm section 185*b* of the operating lever 180 are in the ratio of La:Lb=2:1. However, as long as La>Lb, an amplification effect corresponding to the ratio of the lengths can be obtained. If the ratio is increased, a movement amount of the valve element 160 will decrease reciprocally proportionally in relation to a movement amount of the pressure receiving member 140. Therefore, an ideal ratio would be in the range of La:Lb=1.2:1 to 3:1.

In the present embodiment, a structure is presented in which the ink stored in the ink tank 18 is supplied by a difference in the heights (hydraulic head) of the ink tank 18 and the pressure regulating valve 100. However, a similar effect can also be achieved by a pressure method in which the ink is supplied to the pressure regulating valve 100 by application of pressure on an outer periphery of a flexible ink pack by atmospheric pressure or a spring. Furthermore, a mode of movement of the carriage is not limited to monoaxial movement, and can be other modes.

A pressure regulating valve according to the embodiment of the present invention consists of a negative pressure generating unit that is connected to a print head, and is formed by mounting a pressure receiving member and a pressure receiving and biasing unit to a negative pressure chamber, a sealing valve that is connected to an ink reservoir, and is formed by mounting a valve element and a valve element biasing unit in a pressure chamber, and a linkage mechanism that interconnects the negative pressure generating unit and the sealing valve, and that is formed by mounting a swingable operating lever to a communication flow chamber and that interconnects the negative pressure chamber and the pressure chamber. When the pressure receiving member is moved inwardly into the negative pressure chamber, a first engagement section provided at one end of an arm section is pressed against the pressure receiving member, the operating lever is swung, and a second engagement section provided at other end of the arm section causes the valve element to move in a valve opening direction, causing the sealing valve to open. In this linkage structure using the operating lever, a length of a first arm section from a swinging fulcrum to the first engagement section is set greater than a length of a second arm section from the swinging fulcrum to the second engagement section. Due to this, a pressing force conveyed from the pressure receiving member to the first engagement section is amplified according to a ratio of the lengths of the first arm section and the second arm section and conveyed to the sealing valve via the second engagement section. For example, if the ratio of the lengths of the first arm section and the second arm section is 2:1, the pressing force acting on the first engagement section from the pressure receiving member is doubled in the second engagement section before acting on the valve element. Thus, tolerance levels (margins) of variations in the biasing units and fluid pressure of the ink can be increased without increasing the size of the pressure regulating valve, and a pressure regulating valve for an inkjet printer in which a stable ink supply is possible even at higher head supply pressures is provided.

Furthermore, the negative pressure generating unit and the sealing valve are provided on one side face of the casing, while the linkage mechanism is provided on other side face of the casing across from a partition wall. Thus, both the front and the rear of a single casing are effectively utilized in the pressure regulating valve. By this, a pressure regulating valve for an inkjet printer having a simple structure is provided without having to provide multiple layers of the pressure regulating valve or complicating the die.

Furthermore, a first pressure regulating unit and a second pressure regulating unit, each consisting of the negative pressure generating unit, the sealing valve, and the linkage mechanism, are provided one on each side face on either side of the partition wall in a reverse relation, that is, back to back on either side of the partition wall, on the front and the rear of the casing. Thus, by providing two pressure regulating valves in a single casing, a mass and a cost per pressure regulating valve can be reduced. Moreover, by providing two independent pressure regulating functions within a thickness of a single pressure regulating valve, a space occupied by the pressure regulating valve can be reduced. Moreover, the negative pressure chamber of a first negative pressure generating unit and the negative pressure chamber of a second negative pressure generating unit are provided on either side of the partition wall on the front and the rear of the casing in such a way as to partially overlap with each other. Thus, the area occupied by the negative pressure chambers, which characteristically occupy the maximum area in the pressure regulating valve for the inkjet printer, can be made further compact.

Obviously, numerous modifications and variations of the present invention are possible in light of the above teachings. It is therefore to be understood that within the scope of the appended claims, the invention may be practiced otherwise than as specifically described herein.

The invention claimed is:

1. A pressure regulating valve for an inkjet printer, comprising:

a negative pressure generator comprising:

a negative pressure chamber comprising:

a first depressed portion formed by a first surrounding wall in a casing that is to be a base; and a flexible member covering the first depressed portion to connect the first depressed portion to a print head of the inkjet printer, the print head being connected to an ink reservoir through an ink supply channel, the pressure regulating valve is configured to be provided in the ink supply channel to regulate a pressure of an ink to be supplied to the print head;

a pressure receiving member connected to the flexible member; and a pressure device to press the pressure receiving member outwardly with respect to the negative pressure chamber;

a sealing valve comprising:

a pressure chamber comprising:

a second depressed portion formed by a second surrounding wall in the casing; and a first shielding member covering the second depressed portion to connect the second depressed portion to the ink reservoir;

a valve element to open and close a second opening provided in the pressure chamber; and a valve element pressing device to press the valve element in a valve closing direction; and a linkage mechanism comprising:

a communication flow chamber comprising:

a concave groove formed by a third surrounding wall in the casing; and a second shielding member covering the concave groove, the communication flow chamber connecting a first opening and the second opening, the first opening communicating with the negative pressure chamber, the second opening communicating with the pressure chamber; and an operating lever swingably provided in the communication flow chamber and comprising:

an arm section extending in a longitudinal direction of the operating lever and having a first end portion and a second end portion opposite to the first end portion in the longitudinal direction;

a first engagement section provided at the first end portion to engage with and disengage from the pressure receiving member;

a second engagement section provided at the second end portion to engage with and disengages from the valve element; and a swinging fulcrum provided between the first engagement section and the second engagement section in the longitudinal direction, a first length of the arm section between the swinging fulcrum and the first engagement section being greater than a second length of the arm section between the swinging fulcrum and the second engagement section in the longitudinal direction, the first engagement section being pressed against the pressure receiving member to swing the operating lever and the second engagement section moving the valve element in a valve opening direction to open the sealing valve when the pressure receiving member is moved inwardly with respect to the negative pressure chamber against a force applied by the pressure device, wherein the negative pressure generator and the sealing valve are provided on one side face of the casing, and wherein the linkage mechanism is provided on another side face opposite to the one side face with respect to a partition wall.

2. The pressure regulating valve for the inkjet printer according to claim 1, wherein a first pressure regulating mechanism comprises a first negative pressure generator as the negative pressure generator, the sealing valve, and the linkage mechanism, wherein a second pressure regulating mechanism comprises a second negative pressure generator as the negative pressure generator, the sealing valve, and the linkage mechanism, wherein, in the first pressure regulating mechanism, the first negative pressure generator and the sealing valve are provided on one side face of the casing, and the linkage mechanism is provided on another side face opposite to the one side face with respect to a partition wall, and wherein, in the second pressure regulating mechanism, the second negative pressure generator and the sealing valve are provided on the another side face of the casing, and the linkage mechanism is provided on the one side face.

3. The pressure regulating valve for the inkjet printer according to claim 2, wherein the negative pressure chamber in the first negative pressure generator and the negative pressure chamber in the second negative pressure generator are provided so as to have an overlapping area with respect to the partition wall.

* * * * *